US005947822A

United States Patent [19]

Weiss

[11] Patent Number: 5,947,822

[45] Date of Patent: Sep. 7, 1999

[54] METHOD AND APPARATUS FOR WAGERING

[76] Inventor: Malcolm H. Weiss, 2350 Greenboro Dr., Reno, Nev. 89509

[21] Appl. No.: 08/842,549

[22] Filed: Apr. 15, 1997

[51] Int. Cl.[6] ..... A63F 1/00

[52] U.S. Cl. ..... 463/13; 463/12; 463/25; 273/292

[58] Field of Search ..... 273/292; 463/10, 463/11, 12, 13, 22, 29

[56] References Cited

U.S. PATENT DOCUMENTS

| | | | |
|---|---|---|---|
| 5,013,049 | 5/1991 | Tomaszewski . | |
| 5,019,973 | 5/1991 | Wilcox et al. . | |
| 5,042,818 | 8/1991 | Weingardt | 273/292 |
| 5,167,413 | 12/1992 | Fulton . | |
| 5,224,706 | 7/1993 | Bridgeman et al. . | |
| 5,242,163 | 9/1993 | Fulton . | |
| 5,251,897 | 10/1993 | Fulton . | |
| 5,255,915 | 10/1993 | Miller . | |
| 5,265,882 | 11/1993 | Malek . | |
| 5,328,189 | 7/1994 | Malek . | |
| 5,356,140 | 10/1994 | Dabrowski et al. . | |
| 5,377,973 | 1/1995 | Jones et al. . | |
| 5,377,993 | 1/1995 | Josephs . | |
| 5,395,120 | 3/1995 | Malek | 273/292 |
| 5,407,209 | 4/1995 | Prerost . | |
| 5,411,257 | 5/1995 | Fulton . | |
| 5,411,268 | 5/1995 | Nelson et al. . | |
| 5,494,295 | 2/1996 | Potter et al. . | |
| 5,531,440 | 7/1996 | Dabrowski et al. . | |
| 5,531,441 | 7/1996 | Dabrowski et al. | 463/12 |
| 5,531,448 | 7/1996 | Moody . | |
| 5,639,092 | 6/1997 | Macaisa | 273/292 |
| 5,678,821 | 10/1997 | Hedman | 273/292 |
| 5,697,614 | 12/1997 | Potter et al. | 273/292 |
| 5,732,950 | 3/1998 | Moody | 273/292 |

OTHER PUBLICATIONS

J. Scarnes, Scarne's Encyclopedia of GamesHarper & Row, Chapter 16; pp. 276–286, 1973.

*Primary Examiner*—Jessica J. Harrison
*Assistant Examiner*—Sheila Clayton
*Attorney, Agent, or Firm*—Bernard Kreten

[57] ABSTRACT

A gaming device and method in which a player, after having enabled the machine with a wager, is exposed to a conventional blackjack or twenty-one display on a video monitor. The player receives two cards face up and the dealer receives one card face up and one card face down. The player then has the option of continuing to play the blackjack hand to its conclusion. Should the blackjack game be continued unimpeded, an award is based on conventional blackjack rules. This includes adding cards to approach or equal the numeric value twenty-one. Should the player instead embark upon draw poker, the dealer's cards (initially one card face up and one card face down) are removed from view on the video monitor. In this alternative, the player will keep the two face up cards that have already been dealt the player and receive three additional face up cards and then embark upon a game of draw poker. The player is then allowed to improve the initial five cards of the five card draw poker hand by replacing certain cards with others. Draw poker results are compared to a pay table.

28 Claims, 4 Drawing Sheets

METHOD AND APPARATUS FOR WAGERING

FIELD OF THE INVENTION

The instant invention is directed to a method and apparatus for wagering. More particularly, the instant invention is directed to a wagering game that allows a player to first evaluate a blackjack hand and then elect either to play the blackjack hand or to convert the player's cards from a blackjack game to a draw poker game.

BACKGROUND OF THE INVENTION

Successful casino games typically require a curious blend of both skill and chance. While the blend of skill and chance varies from game to game, players are also stimulated by a wide variety of different types of games.

The patent to Josephs, U.S. Pat. No. 5,377,993, teaches the use of a modified twenty-one or blackjack wagering game. Josephs envisions not only a pay off based on an outcome associated with playing twenty-one or blackjack, but also contemplates sequestering cards from both the player and the dealer after the blackjack game has been completed for another evaluation based on a pay table simulative of poker. Only a predetermined mix of both the player's cards and certain of the dealer's cards are allowed to be considered in a final poker hand evaluation.

The patent to Malek, U.S. Pat. No. 5,265,882, teaches the use of a method and apparatus for playing a casino game which requires a mixture of twenty-one or blackjack, a modified form of draw poker and baccarat wherein the player simultaneously must play at least two of the three games against third parties, such as the dealer and other players. Each player orients a plurality of cards to occupy at least two of three rows oriented in a pattern. The first row allows the placement of two cards, the second row five cards, and the third row two cards. Thus, if a player decides to engage in all three games, he will be dealt ultimately nine cards for placement by the player in the three rows for maximum hand strengths.

The remaining citations which show the state of the art further diverge even more starkly from the nexus of the instant invention.

SUMMARY OF THE INVENTION

The instant invention is distinguished over the known prior art in a multiplicity of ways. For example, the game is initiated by at least a first wager by the player whereupon the player receives two cards face up and the dealer receives two cards, one up and one down. This initial deal parallels conventional blackjack played according to known, established rules. In one form of the invention, should only the dealer have a natural (e.g., two card) twenty-one, the game ends with the wager made by the player having been awarded to the dealer (i.e., house). If both the dealer and player have "natural" twenty-one, the game is a tie. Assume, however, that the dealer does not have a natural twenty-one. The player then elects to either continue the blackjack game or instead, initiate draw poker, in which event the dealer's hand is removed from view.

Assume that the player elects to play blackjack. Both the dealer and the player are eligible to improve their hand according to conventional, known, established rules, with the dealer being mandated to receive an additional card if the dealer's aggregate value is below a certain standard. First, the player improves his hand to the extent possible and then the dealer improves his hand. When each hand, the dealer's and the player's, is stable, the hands are evaluated and any award due the player or the dealer is made.

Assume instead, however, the player elects to play draw poker. The two cards which the player received initially for the purposes of playing blackjack are then supplemented with three further cards to simulate an initial deal of draw poker. The player has the option of drawing further cards to improve the hand at which point the hand is evaluated for rank against a pay table and an award is made based on the value of the hand vis-a-vis a pay table. Preferably, this wagering game is played on a slot machine having a video display monitor so that if the player elects to play draw poker rather than blackjack, when the dealer's blackjack hand is removed from view, it is replaced with a draw poker pay table.

OBJECTS OF THE INVENTION

Accordingly, it is a primary object of the present invention to provide a new and novel method for wagering including an initial opportunity to partake in blackjack and thereafter elect either to continue with blackjack or to embark upon a draw poker game in which event the player's cards from blackjack remain for utilization by the player during the course of the draw poker game.

A further object of the present invention to provide a method as characterized above and an apparatus which lends itself for game deployment on a video-type slot machine.

A further object of the present invention to provide a method and apparatus as characterized above which stimulates the player, adds to the player's enjoyment and adds another dimension of skill to the game.

It is a further object of the present invention to provide a method and device as characterized above in which the player at his sole discretion can either play or abandon an initial blackjack game, and if the player elects to abandon the blackjack game, proceed directly to a draw poker game.

Viewed from a first vantage point, it is an object of the present invention to provide a method for playing a wagering game, the steps including: having a player make a wager; dealing two cards face up to a player; dealing one card face up and another card face down to a dealer; having the player elect to either play twenty-one relying on all the dealt cards or to play draw poker while retaining only the player's two cards; playing blackjack if the player so elects including receiving additional player cards at the discretion of the player and receiving dealer cards according to a preestablished protocol and then awarding the player if warranted; or playing draw poker if the player so elects including the dealing of three new cards to the player; allowing the player to improve the dealt hand by discarding some or none of the five cards and substituting the discards with new cards; evaluating the improved player poker hand against a pay table to determine if an award is due the player, and awarding the player if warranted.

Viewed from a second vantage point, it is an object of the present invention to provide an apparatus for wagering and playing either a blackjack game or a draw poker game, comprising, in combination: means for receiving a wager, means for displaying two blackjack hands, one hand for a dealer having one card face up and one card face down and one hand for a player with two cards face up; means for electing by the player whether to continue blackjack or to play draw poker, means for continuing blackjack by the player including receiving additional cards at the discretion of the player, and means for adding cards to the dealer hand based on a preestablished protocol, and means for evaluating final hands for both the dealer and player including means for awarding the player if the player's hand is superior to the dealer's hand; means for playing draw poker upon election by the player including means for displaying three more player cards face up to supplement the existing two face up cards; means for discarding unwanted player cards; means for providing new replacement cards; means for evaluating the player's final hand against a pay table; means for awarding the player if the player's hand is recognized in the pay table.

These and other objects will be made manifest when considering the following detailed specification when taken in conjunction with the appended drawing figures.

DESCRIPTION OF PREFERRED EMBODIMENTS

Figure 1:
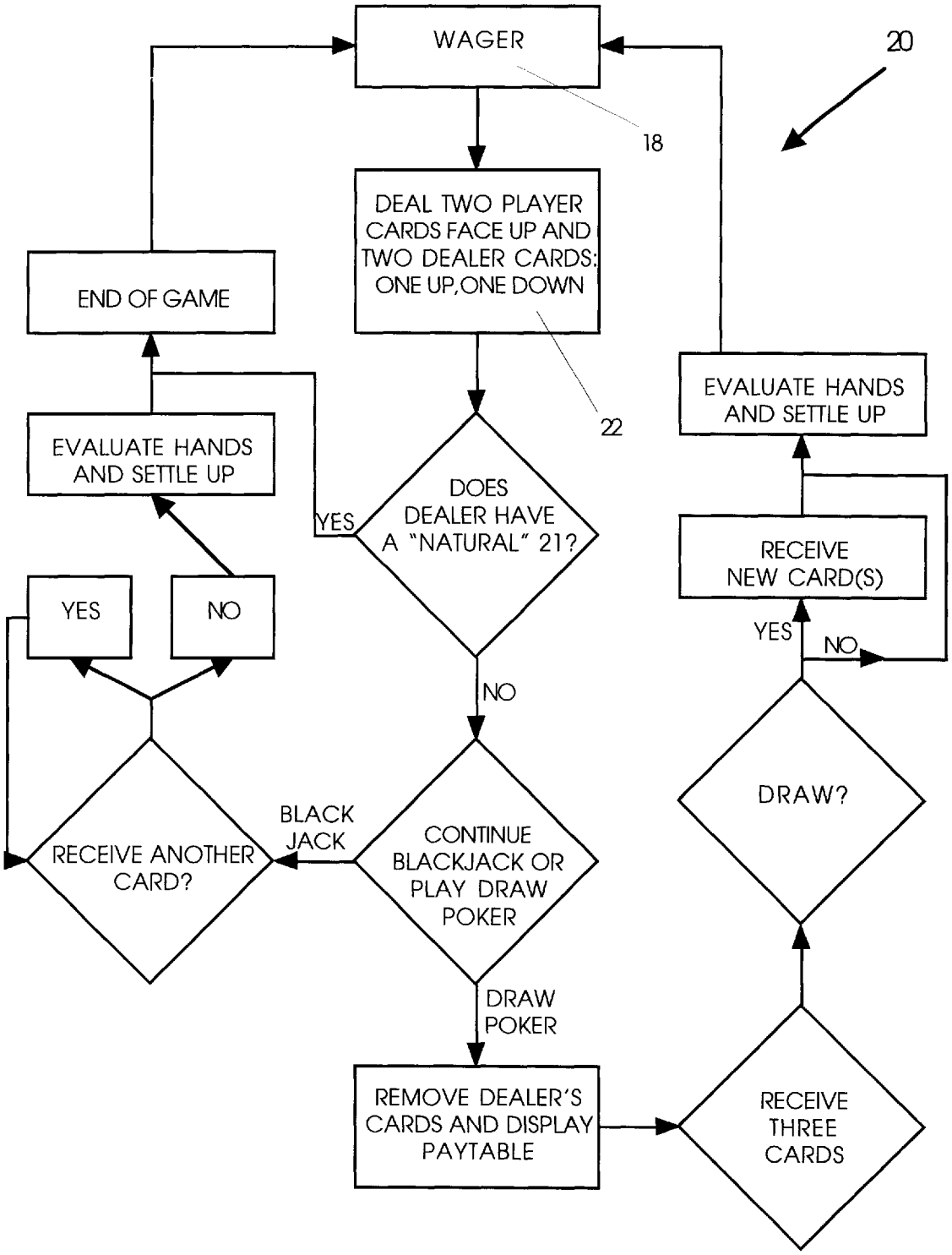
FIG. 1 is a flow chart of the method for playing the wagering game according to the present invention.

Considering the drawings, wherein like reference numerals denote like parts throughout the various drawing figures, reference numeral 10 (FIG. 2) is directed to the apparatus (i.e. gaming machine) according to the present invention and reference numeral 20 (FIG. 1) is directed to the flow chart associated therewith.

In its essence, the gaming machine 10 includes a video display monitor 2, an input area for cash or tokens 4 or currency 6 and a plurality of decision making buttons 8 to enable the machine. Credit is inputted via inputs 4 or 6 and one decision making button 8 is pressed to begin the game by making a wager. The decision making button may be one of several buttons available on an associated panel 12 and can include features such as "bet one" or "maximum bet".

Figure 2:
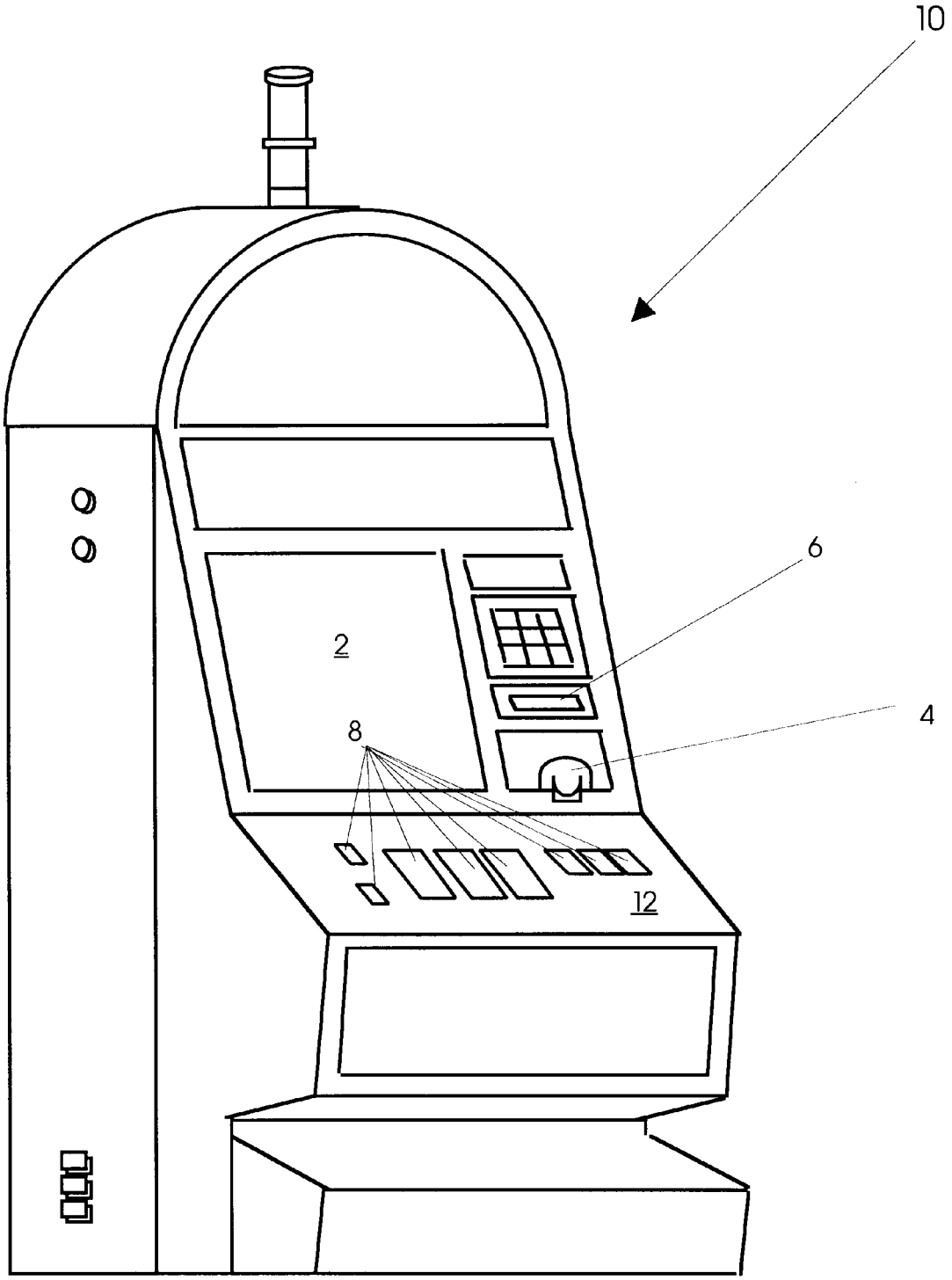
FIG. 2 is a visual depiction of a wagering machine associated with the instant invention.
Figure 3:
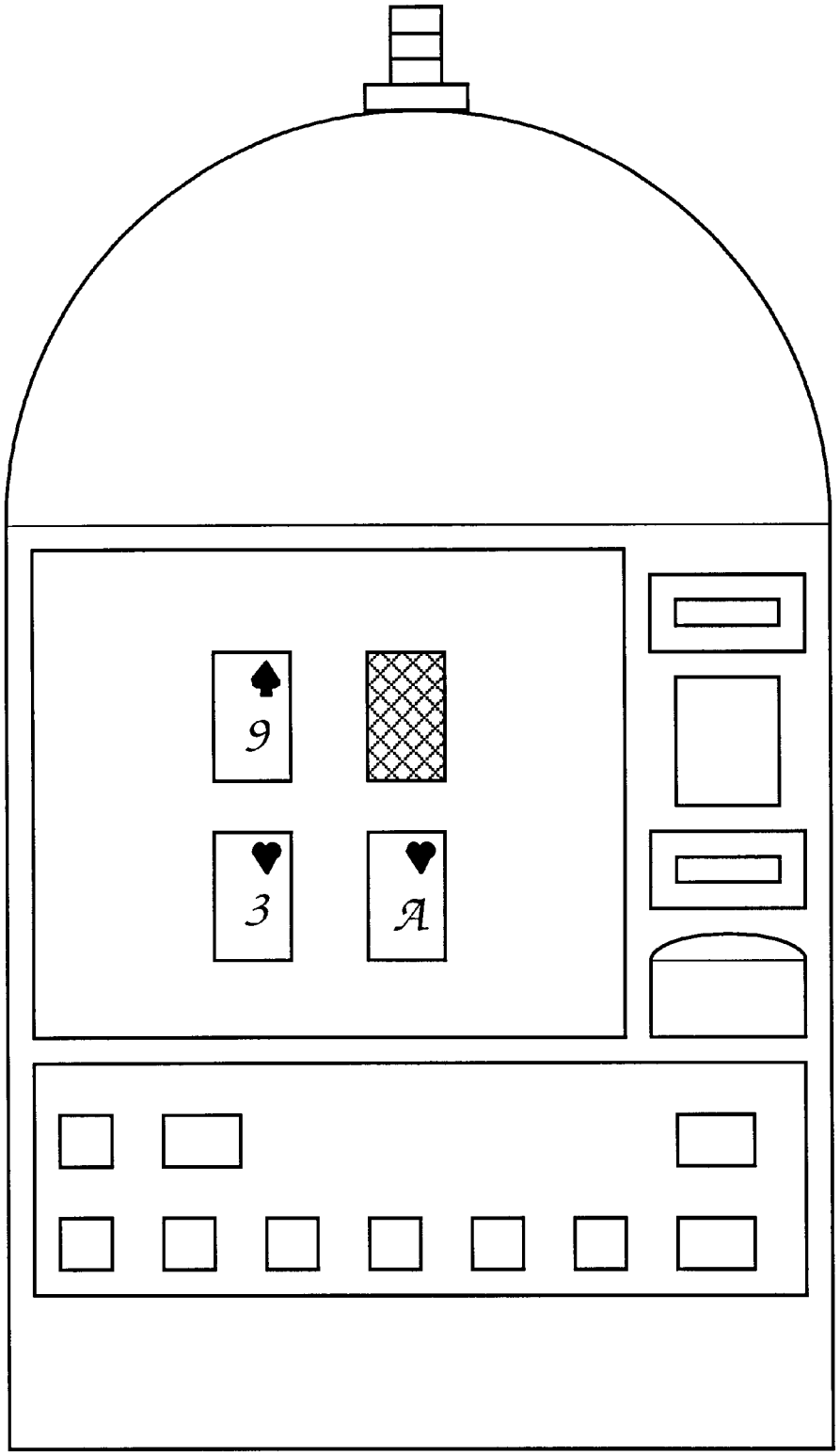
FIG. 3 denotes an initial exemplary screen that appears to a player on a video monitor upon enablement of the game by placing a wager.

Referring to the flow chart 20 at FIG. 1, once a wager has been made, the exemplary FIG. 3 depiction on monitor 2 will appear. This correlates to block 22 of FIG. 1. The player will be provided with two cards in his hand, both face up while the dealer's cards will be displayed with one card face up and one card face down. This initiates the conventional game of blackjack or twenty-one, where the object of the game is to approach or equal twenty-one without going over. In a preferred form of the invention, should the dealer have a "natural" twenty-one (i.e., an aggregate value of the two cards on the monitor 2 equaling twenty-one), the game is automatically over and the player is entitled to reinitialize the game by placing another wager as shown in wager box 18 of FIG. 1. As in conventional blackjack, should both the dealer and the player have "natural" twenty-ones the game is a tie.

It is also contemplated that should be dealer have an exposed ace as the face up card of the two dealer cards initially dealt, the video monitor 2 may prompt the player to buy "insurance". This means that for an additional wager through wager receiving area 4, 6 or by manipulating one of the credit buttons 8 (should the player have credits available on the machine), the player will be insulated from the effect of the dealer having drawn a two card aggregate of twenty-one. With this option, the game becomes a push (e.g. tie) if the dealer indeed has twenty-one and the game can be reinitialized. If the dealer does not have twenty-one in two cards, the "insurance" will have been spent by the player. The player can complete the blackjack game or proceed to the draw poker portion of the game.

Assume, however, that the dealer alone does not have a natural twenty-one, there is no tie and that the player, having evaluated his two face up cards vis-a-vis the one exposed dealer card, elects to continue playing blackjack. In such an event, the player has the option of utilizing one of the decision making buttons 8 for a "hit" i.e., an additional card and continues to take additional cards until the player is satisfied that he has approached or equaled twenty-one without exceeding twenty-one. Should the player exceed twenty-one, the game is over and the player loses. Referring to FIG. 1, if the player "busts" (goes over twenty-one) the "receive another card" box automatically defaults to a "no" decision, ending the game. Once the player is satisfied with his hand and has not exceeded twenty-one, the dealer's second down card is exposed and the dealer improves his hand according to an established protocol. For example, it is required in certain establishments that the dealer is required to take additional cards if the aggregate of the dealer's cards are sixteen or less. In any event, once the dealer has taken the number of cards or stood pat as mandated by the protocol, an evaluation of the hands is made and the wagers are settled based on whether or not the player has won or lost. The player can then reinitialize the game by making another wager through wager box 18.

Figure 4:
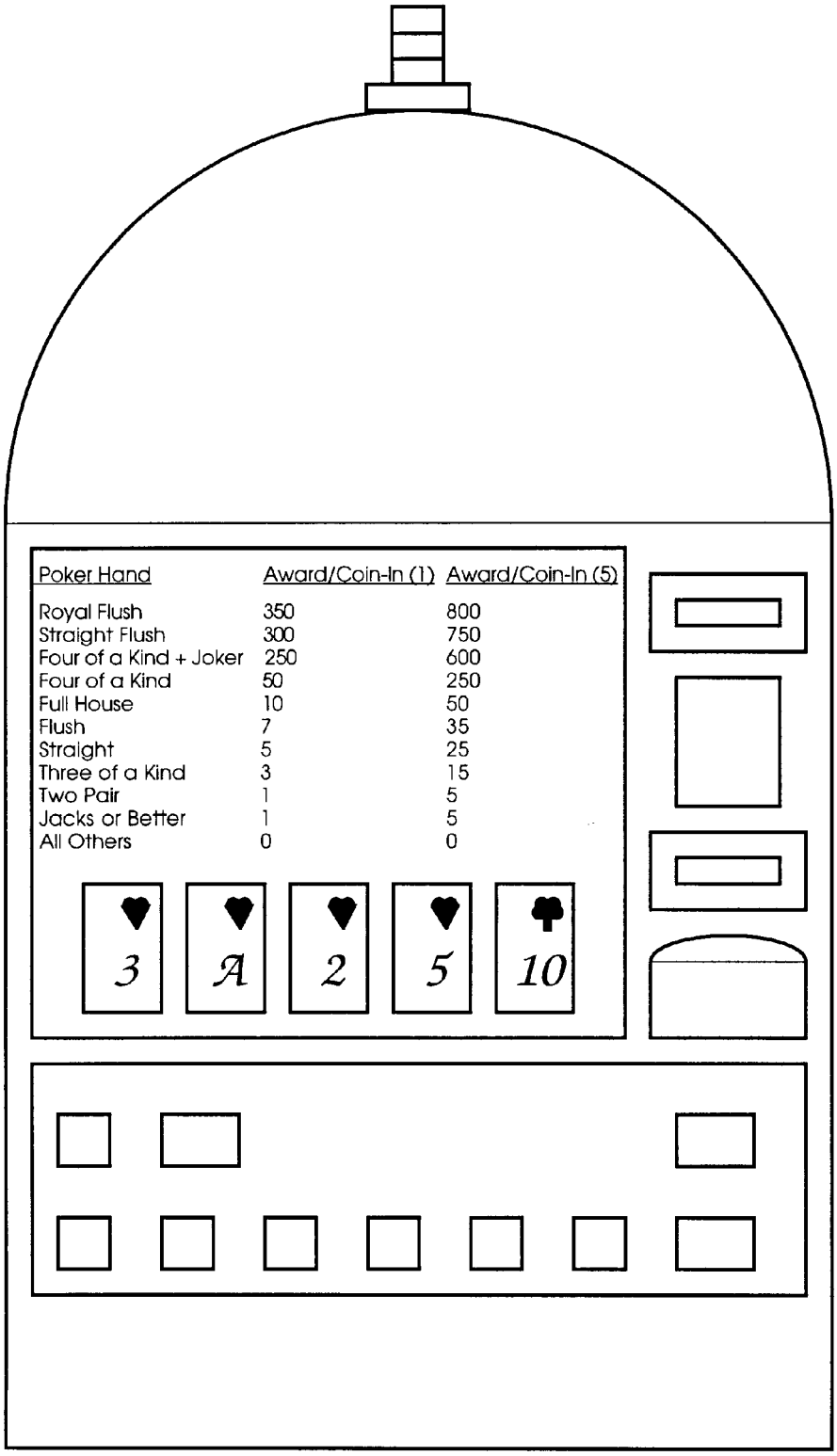
FIG. 4 reflects the visual depiction on the video monitor of the game machine should the player elect to embark upon draw poker rather than continuing with blackjack.

Assume, however, that instead of playing blackjack, the player has elected to play draw poker. Exercising this option may be preceded by an additional wager via a button 8 (or money input 4, 6) in order to exercise the option. Once the decision making button 8 is pressed to enable the draw poker game, the dealer's cards are then removed from the display on the video monitor 2 and are no longer available for the duration of the game. This means, of course, that should the game involve only a fifty-two card deck, the dealer's cards removed from circulation cannot reappear in the player's hand. If a multi-deck game is instead contemplated, cards of identical value may appear in the player's hand, but will have been derived from one of the other multiple decks. Preferably, a draw poker pay table replaces the dealer's hand per FIG. 4.

In any event, the two cards initially allocated to the player are supplemented by three new cards, defining a five card draw poker hand and all displayed face up. The player next enjoys the option of improving his hand by discarding cards of no interest to the player and drawing an equal number of new cards to improve the hand. The next improved hand is compared with a pay table to determine whether or not an award is due the player for having achieved a finished hand of a certain rank or not. Typically, pay tables will distribute awards for hands as low as a pair of jacks and will increase the amount awarded up to a royal flush. By way of example, assume that the player elects to play draw poker and therefore the hand in FIG. 3 evolves to the hand shown in FIG. 4. The player may elect to discard the ten of clubs in hopes of fulfilling either a straight flush, a flush, a straight or a high pair.

If a multi-deck version of the game exists on the machine, hands having higher values, such as five aces of the same suit, will have much higher payouts. It is also contemplated that in addition to or in lieu of the multi-deck arrangement, jokers may be included in the deck(s) of cards. A joker can assume the most beneficial value for the player (or dealer) or the value of the joker may be designated by the player by way of enabling the decision making buttons 8.

In addition, other options are available with respect to the blackjack game. As mentioned, rather than have the dealer win all "natural" blackjacks, if the player also has a natural blackjack, that may be viewed as a tie. In addition, the player may or may not be allowed to split any pair in the course of the blackjack game. If a split occurs, there may be another wager. The player also may or may not be allowed (or required) to "double down" (i.e., increase an initial wager) or may be allowed to do so only if a ten or eleven (ace) is showing or especially an aggregation of two cards totaling ten or eleven. In blackjack there may be an automatic win for the player if the player can aggregate a total of five or perhaps six cards without going over twenty-one.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A method for playing a wagering game, the steps including:

having a player make a wager;

dealing two cards face up to a player from a deck of cards;

dealing one card face up and another card face down to a dealer from the deck;

having the player elect to either play blackjack against the dealer relying on all the dealt cards or to play draw poker absent the dealer's hand and against a paytable by relying only on the player's cards;

playing blackjack after viewing only the three exposed cards if the player so elects and including receiving additional player cards at the discretion of the player and the dealer receiving additional cards according to a preestablished protocol and awarding the player if warranted; or playing draw poker if the player so elects including dealing three more cards from the deck to the player supplementing the two predealt player cards, draw poker defined by receiving five cards and being afforded the opportunity at the sole discretion of the player to improve the player's hand by substituting one or more cards from the unplayed deck;

allowing the player to improve the dealt hand by discarding cards and substituting new cards from the deck;

evaluating the improved player poker hand against the pay table to determine if award is due the player, and awarding the player if warranted.

2. The method of claim 1 including awarding the dealer a win if the dealer displays twenty-one in the first two cards dealt to the dealer.

3. The method of claim 2 including allowing the player to purchase insurance should the dealer's first face up card be an ace or ten value.

4. The method of claim 3 including allowing the player to split any pair during the course of the blackjack game.

5. The method of claim 4 including allowing the player to increase the player's wager should an aggregate total of the player's initial first two cards include a ten or an eleven face value.

6. The method of claim 5 including allowing the player to automatically win at blackjack if an aggregate total of five cards is less than or equal to twenty-one.

7. The method of claim 6 including utilizing a single deck of cards in the play of the game and including a joker in the single deck of cards.

8. The method of claim 7 including utilizing multiple decks in the play of the game.

9. The method of claim 8 including removing from view the dealer's cards should the player elect to play draw poker rather than blackjack.

10. The method of claim 9 including displaying a pay table for draw poker.

11. An apparatus for wagering and playing either a blackjack or draw poker, comprising, in combination:

means for receiving a wager, means for displaying two blackjack hands from a deck of cards, one hand for a dealer with one card face up and another face down and one hand for a player with two cards face up;

means for electing by the player whether to continue blackjack against the dealer's hand or to play draw poker absent the dealer's hand and against a paytable, means for continuing blackjack by the player after viewing the three exposed cards including receiving additional cards at the discretion of the player, and means for adding cards to the dealer hand based on a preestablished protocol, and means for evaluating final hands for both the dealer and player including means for awarding the player if the player's hand is superior to the dealer's hand;

means for playing draw poker upon election by the player including means for displaying three more player cards face up from the deck to supplement the existing two face up cards, draw poker defined by receiving a total of five cards and being afforded the opportunity at the sole discretion of the player to improve the player's hand by substituting one or more cards from the unplayed deck;

means for discarding unwanted player cards;

means for providing new replacement cards from the deck;

means for evaluating the player's final hand against the pay table; and means for awarding the player if the player's hand is recognized in the pay table.

12. The apparatus of claim 11 including means for allowing the player to make additional wagers as a function of abandoning the blackjack game and proceeding with the draw poker game.

13. The apparatus of claim 12 including means to allow the player to purchase insurance to offset the effect of the dealer having a natural twenty-one in the first two dealer cards.

14. The apparatus of claim 13 including means to post a pay table viewable to the player should the player elect to play draw poker rather than blackjack.

15. The apparatus of claim 14 including means to allow a player to split a pair during the course of the blackjack game including means to enable an additional wager.

16. The apparatus of claim 15 including means to allow the player to increase the magnitude of an initial wager if an aggregate total of a ten or eleven face value is shown on the player's first two cards.

17. An apparatus for playing a wagering game, comprising, in combination:

means for receiving a wager;

means for dealing a single two card hand to both a dealer and a player;

means for electing by the player to play blackjack against the dealer or draw poker against a paytable.

18. The apparatus of claim 17 wherein said means for dealing both said single two cards hands select from a single deck of playing cards.

19. The apparatus of claims 18 wherein said means for dealing both said two cards hands includes means for dealing two cards face up to the player and dealing one card face up and another card face down to the dealer.

20. The apparatus of claim 17 further including means for continuing blackjack if elected by the player including means for receiving additional cards at the discretion of the player, and means for adding cards to the dealer hand based on a preestablished protocol, and means for evaluating final hands for both the dealer and player including means for awarding the player if the player's hand is superior to the dealer's hand.

21. The apparatus of claim 20 further including means for playing draw poker upon election by the player including means for displaying three more player cards face up to supplement the existing two face up cards.

22. The apparatus of claim 21 further including means for discarding unwanted player cards, means for providing new replacement cards, means for evaluating the player's final hand against said paytable, and means for awarding the player in accordance with said paytable.

23. A method for playing a wagering game, the steps including:

having a player make a wager;

dealing two cards face up to a player of cards;

dealing one card face up and another card face down to a dealer having the player elect to either play blackjack against the dealer relying on all the dealt cards or to play draw poker absent the dealer's hand and against a paytable by relying only on the player's cards;

playing blackjack if the player so elects and including receiving additional player cards at the discretion of the player and the dealer receiving additional cards according to a preestablished protocol and awarding the player if warranted; or playing draw poker if the player so elects including dealing three more cards to the player supplementing the two predealt player cards;

allowing the player to improve the dealt hand by discarding cards and substituting new cards;

evaluating the improved player poker hand against the pay table to determine if award is due the player, and awarding the player if warranted;

awarding the dealer a win if the dealer displays twenty-one in the first two cards dealt to the dealer;

allowing the player to purchase insurance should the dealer's first face up card be an ace or ten value;

allowing the player to split any pair during the course of the blackjack game; and allowing the player to increase the player's wager should an aggregate total of the player's initial first two cards include a ten or an eleven face value.

24. A method for playing a wagering game, the steps including:

having a player make a wager;

dealing two cards face up to a player from a deck of cards;

dealing one card face up and another card face down to a dealer from the deck;

having the player elect to either play blackjack against the dealer relying on all the dealt cards or to play draw poker absent the dealer's hand and against a paytable by relying only on the player's cards;

playing blackjack after viewing only the three exposed cards if the player so elects and including receiving additional player cards at the discretion of the player and the dealer receiving additional cards according to a preestablished protocol and awarding the player if warranted; or playing draw poker if the player so elects including dealing three more cards from the deck to the player supplementing the two predealt player cards, draw poker defined by receiving five cards and being afforded the opportunity at the sole direction of the player to improve the player's hand by substituting one or more cards from the unplayed deck;

allowing the player to improve the dealt hand by discarding cards and substituting new cards from the deck;

evaluating the improved player poker hand against the pay table to determine if award is due the player, and awarding the player if warranted; and allowing the player to increase the player's wager should an aggregate total of the player's initial first two cards include a ten or an eleven face value.

25. An apparatus for wagering and playing either a blackjack or draw poker, comprising, in combination:

means for receiving a wager, means for displaying two blackjack hands from a deck of cards, one hand for a dealer with one card face up and another face down and one hand for a player with two cards face up;

means for electing by the player whether to continue blackjack against the dealer's hand or to play draw poker absent the dealer's hand and against a paytable, means for continuing blackjack by the player including receiving additional cards at the discretion of the player, and means for adding cards to the dealer hand based on a preestablished protocol, and means for evaluating final hands for both the dealer and player including means for awarding the player if the player's hand is superior to the dealer's hand;

means for playing draw poker upon election by the player including means for displaying three more player cards face up to supplement the existing two face up cards;

means for discarding unwanted player cards;

means for providing new replacement cards;

means for evaluating the player's final hand against the pay table; and means for awarding the player if the player's hand is recognized in the pay table;

means for allowing the player to make additional wagers as a function of abandoning the blackjack game and proceeding with the draw poker game;

means to allow the player to purchase insurance to offset the effect of the dealer having a natural twenty-one in the first two dealer cards;

means to post a pay table viewable to the player should the player elect to play draw poker rather than blackjack;

means to allow a player to split a pair during the course of the blackjack game including means to enable an additional wager; and means to allow the player to increase the magnitude of an initial wager if an aggregate total of a ten or eleven face value is shown on the player's first two cards.

26. An apparatus for wagering and playing either a blackjack or draw poker, comprising, in combination:

means for receiving a wager, means for displaying two blackjack hands from a deck of cards, one hand for a dealer with one card face up and another face down and one hand for a player with two cards face up;

means for electing by the player whether to continue blackjack against the dealer's hand or to play draw poker absent the dealer's hand and against a paytable, means for continuing blackjack by the player after viewing the three exposed cards including receiving additional cards at the discretion of the player, and means for adding cards to the dealer hand based on a preestablished protocol, and means for evaluating final hands for both the dealer and player including means for awarding the player if the player's hand is superior to the dealer's hand;

means for playing draw poker upon election by the player including means for displaying three more player cards face up from the deck to supplement the existing two face up cards, draw poker defined by receiving a total of five cards and being afforded the opportunity at the sole discretion of the player to improve the player's hand by substituting one or more cards from the unplayed deck;

means for discarding unwanted player cards;

means for providing new replacement cards from the deck;

means for evaluating the player's final hand against the pay table; and means for awarding the player if the player's hand is recognized in the pay table; and means to allow the player to increase the magnitude of an initial wager if an aggregate total of a ten or eleven face value is shown on the player's first two cards.

27. A method for playing a wagering game, the steps including:

receiving a solitary wager from a player;

dealing a single two card hand to both a dealer and the player;

electing by the player to play blackjack against the dealer or draw poker against a paytable after the dealing of the single two card hand to both the dealer and the player;

playing draw poker upon election by the player including the step of having the player receive three more cards to supplement the predealt single two card player hand to form a five card player draw poker hand, and substituting one or more cards from the player draw poker hand with unplayed cards at the sole discretion of the player to improve the player's hand.

28. An apparatus for playing a wagering, comprising, in combination:

means for receiving a solitary wager;

means for dealing a single two card hand to both a player and a dealer;

means for electing by the player to play blackjack against the dealer or draw poker against a paytable after the dealing of the single two card hand to both the player and the dealer;

means for playing draw poker upon election by the player including means for receiving three more cards to supplement the predealt single two card player hand to form a five card player draw poker hand, and means for substituting one or more cards from the player draw poker hand with unplayed cards at the sole discretion of the player to improve the player's hand.

* * * * *